United States Patent [19]

McLaughlin et al.

[11] Patent Number: 4,645,077

[45] Date of Patent: Feb. 24, 1987

[54] RECEIPT HOLDER

[76] Inventors: Brenda C. McLaughlin; John W. McLaughlin, both of 13834 Hollowgreen, Houston, Tex. 77082

[21] Appl. No.: 769,121

[22] Filed: Aug. 26, 1985

[51] Int. Cl.[4] ..... B65D 85/48

[52] U.S. Cl. ..... 206/449; 206/37; 206/38; 206/39; 206/215; 206/425; 220/337; 220/339

[58] Field of Search ..... 206/37, 38, 39, 215, 206/232, 235, 259, 425, 449, 387; 150/52 B; 220/334, 336, 337, 339; 229/68 R, 68 C, 77

[56] References Cited

U.S. PATENT DOCUMENTS

| | | | |
|---|---|---|---|
| 1,637,229 | 7/1927 | Merensky | 206/37 |
| 2,278,011 | 3/1942 | Murdock | 296/97 |
| 2,286,389 | 6/1942 | Sowin | 206/259 |
| 2,410,987 | 11/1946 | Mevi | 206/38 |
| 2,483,304 | 9/1949 | Jogel | 206/232 |
| 2,536,725 | 1/1951 | Cleveland | 206/232 |
| 2,713,368 | 7/1955 | Thomas | 206/39 |
| 2,727,547 | 12/1955 | Moon | 206/38 R |
| 2,846,766 | 8/1958 | Harter | 206/37 |
| 3,127,225 | 3/1964 | Oehrlein | 220/339 |
| 3,306,326 | 2/1967 | Thomas | 206/39 |
| 3,595,433 | 7/1971 | Jones | 220/31.5 |
| 3,651,983 | 3/1972 | Haugen | 220/339 |
| 3,765,531 | 10/1973 | Hardy, Sr. | 206/449 |
| 3,874,501 | 4/1975 | Cronheim | 206/425 |
| 3,927,442 | 12/1975 | Foster | 206/39 |
| 4,225,038 | 9/1980 | Egly | 206/425 |
| 4,262,838 | 4/1981 | Mackenzie | 229/72 |
| 4,314,637 | 2/1982 | Posso | 206/387 |
| 4,347,537 | 8/1982 | Schoettle et al. | 360/132 |
| 4,401,209 | 8/1983 | Salmond et al. | 206/37 |
| 4,449,628 | 5/1984 | Egly et al. | 206/425 |

FOREIGN PATENT DOCUMENTS

| | | | |
|---|---|---|---|
| 393179 | 5/1965 | Switzerland | 220/339 |

*Primary Examiner*—Joseph Man-Fu Moy
*Assistant Examiner*—David T. Fidei
*Attorney, Agent, or Firm*—Kenneth A. Roddy

[57] ABSTRACT

A container for use in holding receipts or the like comprises a hollow body formed of contiguous bottom, front, rear, and opposed side panels, and a cover integrally hinged to the top of the rear panel which is divided into contiguous top and front portions by a second integral hinge spaced parallel to the integrally hinged juncture of the cover with the rear panel. The cover is pivotal about its hinged juncture with the rear panel and the top and front portions of the cover are pivotal about the second integral hinge. A retaining tab integral with the front portion of the cover is adapted to engage the interior surface of the front panel of the body when the cover is closed and is disengaged therefrom upon upward and pivotal outward movement of the cover. A lifting tab integral with the front portion facilitates opening and closing of the cover. A fabric fastener on the exterior surface of the rear panel allows the container to be releasably attached to other objects for placement at a convenient location. The container may be provided with small concave detents formed in each side edge of the top portion of the cover which biasly receive small protuberances extending laterally inward from the top portion of each side panel to maintain the cover in the closed position.

6 Claims, 5 Drawing Figures

RECEIPT HOLDER

BACKGROUND OF THE INVENTION

1. Field of the Invention

This invention relates generally to holders, and more particularly to a unitary receipt holder having a novel integral hinged closure which may be attached to other articles.

2. Brief Description of the Prior Art

It is a common problem to keep and store receipts in a convenient location until it is time to refer to them in maintaining a record of expenses. Receipts for credit card purchases are usually thin tissue paper carbon copies of the purchase ticket. These receipts are commonly given to the customer in department stores and resturants, and the only convenient place for the customer to keep the receipt is to fold it and place it in a shirt pocket or purse. These receipts are usually carried about in the pocket or purse for days or weeks, or they are removed when the customer returns home and put on a dresser along with other pocket articles. They often get lost or discarded.

The credit card company sends a monthly statement showing the charges for a certain time period, and the customer may use the receipts he has been keeping for that time period to verify the monthly statement. The statement often does not give details of the transaction such as found on the actual sales ticket or which the customer may have written on the receipt. Some customers, for example, write the name of the resturant, the names of clients entertained, and purpose of the expense on the receipt which they keep.

Gasoline credit card purchases are another example. Until recently, the monthly statement from gasoline companies would include a copy of the original sales ticket. Now however, the customer only receives the invoice numbers, location of the service station, and amount of purchase. Under the old system, the customer could write in on the receipt and sales ticket such information as the license number of the vehicle, the amount of gasoline purchased, the vehicle mileage, and the signature of the person making the purchase. This allowed the customer to ascertain whether the expense was for business or pleasure, who used his card, which vehicle the expense was for, and even check his gasoline mileage. With the new system, the customer has none of this information unless he has his original receipt.

In summary, it is very important for a variety of reasons to maintain receipts for purchases, particularly credit card purchases in a safe convenient location.

There are several patents which disclose various holders and containers having hinged closures which may be used for filing and storing papers and other articles. Jones, U.S. Pat. No. 3,595,433 discloses a filing case card file with a drop front formed as a unitary flexible plastic structure and having a dropfront panel which is released when the filing case is opened. The cover of the case has a latch which engages an integral latch on the front panel. The latch on the cover comprises a lift tab which fits underneath an opposed tab on the front panel. When the tab is pulled outward, the resilient front panel swings forward.

Murdock, U.S. Pat. No. 2,278,011 discloses a paper pack holder suited for use as a sun visor in an automobile. The device comprises a cabinet mounted for oscillatory adjustment on a bracket carried by a support. The cabinet side wall has a slot for dispensing sheets of paper and a spring loaded plate for urging the pack of papers into proper position.

Mackenzie, U.S. Pat. No. 4,262,838 discloses an expandable file folder having a removable cover. The cover is completely removable and comprises a flat rectangular sheet of material which is attached to the file folder by means of fabric fastener strips.

Schoettle et al, U.S. Pat. No. 4,347,537 discloses a tape cartridge assembly comprising a tape cartridge housing having a bottom wall, top wall, two side walls, and front and rear walls. The front wall is releasably connected to the bottom of the side walls. The top wall is a lid which is hingedly connected to the rear wall and the front wall and is foldable into two portions. The lid together with the front wall can be folded about an edge of the rear wall against the outer surface of the bottom wall. Lateral projections on the front wall engage recesses in the front edges of the side walls to form a releasable connection.

The prior art in general, and these patents in particular, do not disclose the present invention of a receipt holder having a hollow body formed of contiguous bottom, front, rear, and opposed side panels, and a cover integrally hinged to the top of the rear panel which is divided into contiguous top and front portions by a second integral hinge such that the cover is pivotal about its hinged juncture with the rear panel and the top and front portions of the cover are pivotal about the second integral hinge. A retaining tab integral with the front portion of the cover engages the interior surface of the front panel of the body when the cover is closed and is disengaged therefrom upon upward and pivotal outward movement of the cover.

A lifting tab integral with the front portion facilitates opening and closing of the cover. A fabric fastener on the exterior surface of the rear panel allows the container to be releasably attached to other objects for placement at a convenient location. The container may be provided with small concave detents formed in each side edge of the top portion of the cover which biasly receive small protuberances extending laterally inward from the top portion of each side panel to maintain the cover in the closed position.

SUMMARY OF THE INVENTION

It is therefore an object of the present invention to provide a receipt holder which will conveniently store receipts for purchases such as credit card receipts until such time as they are needed for reference.

Another object of this invention is to provide a receipt holder which is compact and easily installed in a convenient location such as an automobile or carried in a purse.

Another object of this invention is to provide a receipt holder which is easily and quickly opened and closed.

Another object of this invention is to provide a receipt holder which is attractive in appearance, simple in construction, economical to manufacture, and rugged and durable in use.

These and other objects of the invention will become apparent from time to time throughout the specification and claims as hereinafter related.

The above noted objects and other objects of the invention are accomplished by a receipt holder having a hollow body formed of contiguous bottom, front, rear, and opposed side panels, and a cover integrally hinged to the top of the rear panel which is divided into contiguous top and front portions by a second integral hinge such that the cover is pivotal about its hinged juncture with the rear panel and the top and front portions of the cover are pivotal about the second integral hinge. A retaining tab integral with the front portion of the cover engages the interior surface of the front panel of the body when the cover is closed and is disengaged therefrom upon upward and pivotal outward movement of the cover.

A lifting tab integral with the front portion facilitates opening and closing of the cover. A fabric fastener on the exterior surface of the rear panel allows the container to be releasably attached to other objects for placement at a convenient location. The container may be provided with small concave detents formed in each side edge of the top portion of the cover which biasly receive small protuberances extending laterally inward from the top portion of each side panel to maintain the cover in the closed position.

DESCRIPTION OF THE PREFERRED EMBODIMENT

Figure 1:
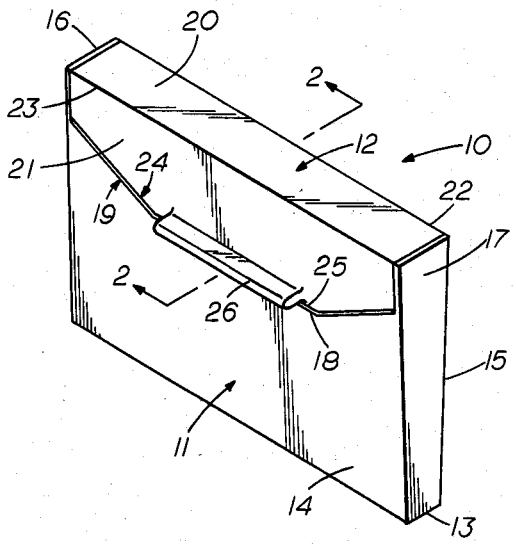
FIG. 1 is an isometric view of a preferred receipt holder in the closed position in accordance with the present invention.

Referring to the drawings by numerals of reference, there is shown a preferred receipt holder 10 comprising a hollow generally rectangular container body 11 and a hinged cover 12. The cover 12 is integrally hinged to the container body 11 as will be described hereinafter. The container body 11 has a contiguous bottom panel 13, front panel 14, rear panel 15, and opposed side panels 16 and 17.

The term "contiguous" as used throughout is intended to mean integrally joined at their mating surfaces, thus with respect to the container body 11, the bottom panel 13, the front panel 14, the rear panel 15, the cover 12, and the opposed side panels 16 and 17 are joined together in the molding operation so as to form an integral unit.

The front panel 14 is shorter than the side panels 16 and 17 and its upper edge tapers angularly downward from its juncture with each side panel terminating in a central flat horizontal edge 18 to form a generally flat bottomed V-shaped top edge 19.

The cover 12 is an extension of the rear panel 15 and is divided into a rectangular top portion 20 and a rectangular front portion 21 by parallel, spaced integral hinges 22 and 23. The hinges 22 and 23 are commonly referred to in the plastics field as "living hinges" and are formed into the material during the molding operation. The front portion 21 of the cover 12 is narrower than the side panels 16 and 17 to be received therebetween and its leading edge 24 tapers angularly downward from each side edge to terminate in a central flat horizontal edge to form a generally flat bottomed V-shaped edge 25 which is received in abutting relation on the top edge 18 of the front panel 14 in the closed position.

Hinge 22 is disposed relative to the top edges of the side panels 16 and 17 such that when folded approximately 90°, the top portion 20 of the cover 12 will be level with the top edges of the side panels. The second hinge 23 is parallel to the hinge 22 and located at a distance therefrom equivalent to the length of the top edges of the side panels 16 and 17. The width of the rectangular top portion 20 is such that the top portion will be received within and between the top edges of the side panels 16 and 17 in the closed position.

A rectangular lift tab 26 extends perpendicularly outward from the horizontal portion of the leading edge 24 of the top portion 21 of the cover 12. A retaining tongue or tab 27 extends along the horizontal portion of the cover 12. The retaining tab 27 is offset from the front portion 21 of the cover 12 approximately the thickness of the front panel 14 and extends parallel to the front portion 21. In the closed position, the retaining tab 27 will extend inwardly along the interior surface of the front panel 14 and be biased thereagainst by the inherent resilient properties of the plastic material and hinges.

Figure 3:
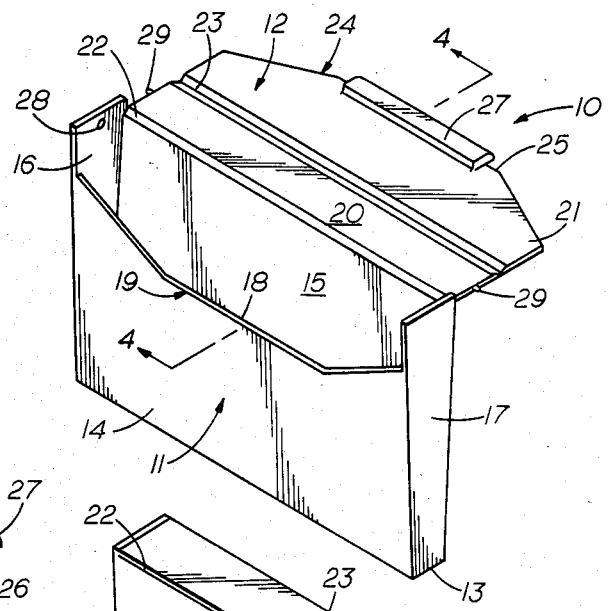
FIG. 3 is an isometric view of the receipt holder in the open position in accordance with the present invention.
Figure 4:
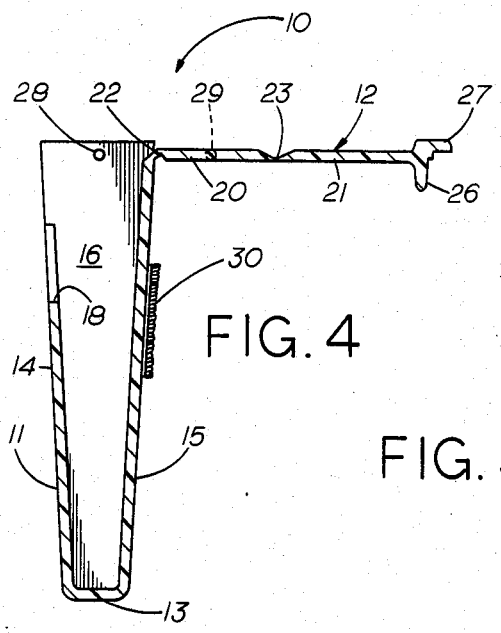
FIG. 4 is a side elevational view in cross section of the receipt holder in the open position taken along line 4—4 of FIG. 3.

As best shown in FIGS. 3 and 4, a small concave detent 28 is formed in each side edge of the top portion 20 of the cover 12. The top portion of each side panel 16 and 17 is provided with a small protuberance 29 which extends laterally inward. When the cover 12 is in the closed position, the protuberances 29 will snap fit into the detents 28 to maintain the cover in the closed position. It should be understood from the foregoing, that to open the cover 12 of the receipt holder, the lift tab 26 must be pulled upwardly and outwardly in order to disengage the retaining tab 27 and the protuberances 29.

Figure 2:
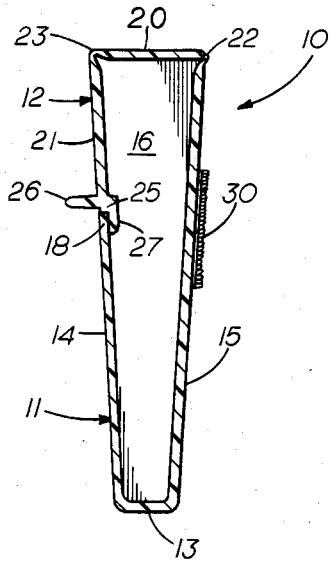
FIG. 2 is a side elevational view in cross section of the receipt holder taken along line 2—2 of FIG. 1.

As seen in FIGS. 2 and 4, a small strip of one element of a fabric fastener 30 is secured to the exterior surface of the rear panel 15 by suitable adhesive means. The mating element of the fastener (not shown) may be installed in any convenient location where the receipt holder might be used, such as on the dashboard of a vehicle or on a wall, etc. The receipt holder may then be releasably installed in any convenient location and easily removed therefrom.

Figure 5:
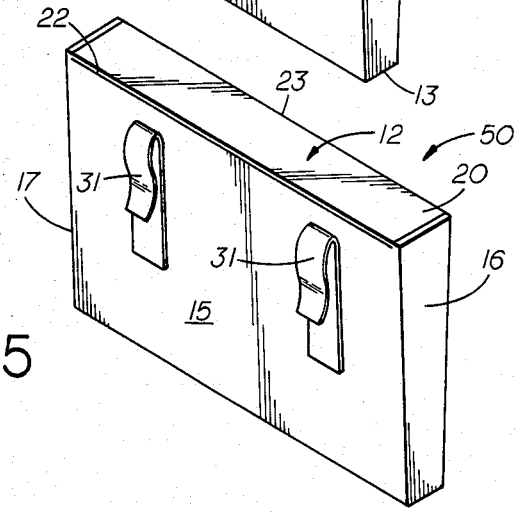
FIG. 5 is an isometric view taken from the rear of the receipt holder having alternate attaching means.

FIG. 5 shows a receipt holder 50 having alternate attaching means. In the embodiment of FIG. 5, a pair of laterally spaced spring clips 31 are secured to the exterior surface of the rear panel 15 by suitable means conventional in the art. The clips 31 allow the holder 50 to be releasably attached to a sun visor or belt. The other components of the holder 50 are identical those previously described, and the same numbers are used to designate the identical parts. To avoid repetition, the description of the aforementioned parts will not be repeated here.

OPERATION

In use, one element of a fabric type fastener which may be furnished with the holder is installed at a desired location such as on the dashboard of a vehicle. The receipt holder is then installed thereon by pressing the holder onto the fastener and thus mating the element attached to the rear panel to the first mentioned element.

When the user has filled out his sales ticket including any additional information he wishes to record and receives the thin paper receipt, he simply grasps the lift tab with his thumb and forefinger and moves it upward and outward to open the cover and repeats the operation to close the cover. The receipts are thus maintained in a convenient location in a neat and orderly fashion to prevent them from becoming lost or misplaced.

Upon receiving his monthly statement or when desired to record the receipts for his expenses, the holder can be released from the fastener and removed to the desk of the user at the location where the expense records are maintained. By providing an easy to use receipt holder at a convenient location, the user will find it very easy to keep track of various valuable information and save a great deal of time in verifying his monthly statement.

For example, the user making a gasoline purchase with a credit card could write in on the receipt and sales ticket such information as the license number of the vehicle, the amount of gasoline purchased, the vehicle mileage, and the signature of the person making the purchase. This would allow the customer to ascertain whether the expense was for business or pleasure, who used his card, which vehicle the expense was for, and even check his gasoline mileage.

While this invention has been described fully and completely with special emphasis upon a preferred embodiment, it should be understood that within the scope of the appended claims the invention may be practiced otherwise than as specifically described herein.

We claim:

1. A container for use in holding receipts or the like comprising a hollow body formed of contiguous bottom, front, rear, opposed side panels, and a cover extending from said rear panel beyond said side panels, said hollow body and said cover molded together to form an integral unit, said cover hinged to the top of said rear panel by a first integral hinge and divided into contiguous top and front portions by a second integral hinge spaced parallel to the integrally hinged juncture of said cover with said rear panel, said cover pivotal about said first integral hinge at said rear panel and said top and front portions thereof pivotal about said second integral hinge, said first and second integral hinges spaced apart and disposed relative to the top edges of said side panels such that when said cover is in the closed position said cover top portion will be received between said side panels of said body and flush with the top edges of said side panels, a retaining tab integral with said cover front portion offset parallel inwardly adjacent the leading edge thereof and extending a distance therealong to engage the interior surface of said front panel of said body when said cover is in the closed position and disengaged therefrom upon upward and pivotal outward movement, a small concave detent formed in each side edge of said cover top portion, a small protuberance extending laterally inward from the top portion of each said side panel, said protuberances biasly received within said detents when said cover is in the closed position and released from said detents upon pivotal upward movement of said cover top portion, a lifting tab integral with said cover front portion extending perpendicularly outward from the leading edge thereof for moving same upward and pivotally outward to disengage said retaining tab from said front panel interior surface and said cover to the open position, and attaching means adapted to be secured to the exterior of said container for releasably attaching same to other objects.

2. The container according to claim 1 wherein said attaching means comprises one element of a fabric fastener secured to the exterior surface of said rear panel for releasably attaching said container to the mating element of the fastener installed at a convenient location.

3. The container according to claim 1 wherein said attaching means comprises at least one spring clip secured to the exterior surface of said rear panel for releasably attaching said container to other articles.

4. The container according to claim 1 wherein said front panel is shorter than said side panels and the top edge thereof extends angularly downward from its juncture with each said side panel terminating in a central flat horizontal edge to form a generally flat bottomed V-shaped top edge, and said front portion of said cover is narrower than the side panels to be received therebetween and its leading edge extends angularly inward from each side edge to terminate in a central flat horizontal edge to form a generally flat bottomed V-shaped leading edge which is received in abutting relation on said top edge of the front panel when said cover is in the closed position.

5. A container for use in holding receipts or the like comprising a hollow body formed of contiguous bottom, front, rear, opposed side panels, and a cover extending from said rear panel beyond said side panels, said hollow body and said cover molded together to form an integral unit, said cover hinged to the top of said rear panel by a first integral hinge and divided into contiguous top and front portions by a second integral hinge spaced parallel to the integrally hinged juncture of said cover with said rear panel, said cover pivotal about said first integral hinge at said rear panel and said top and front portions thereof pivotal about said second integral hinge, said first and second integral hinges spaced apart and disposed relative to the top edges of said side panels such that when said cover is in the closed position said cover top portion will be received between said side panels of said body and flush with the top edges of said side panels, a retaining tab integral with said cover front portion offset parallel inwardly adjacent the leading edge thereof and extending a distance therealong to engage the interior surface of said front panel of said body when said cover is in the closed position and disengaged therefrom upon upward and pivotal outward movement, a lifting tab integral with said cover front portion extending perpendicularly outward from the leading edge thereof for moving same upward and pivotally outward to disengage said retaining tab from said front panel and said cover to the open position, and one element of a fabric fastener secured to the exterior surface of said rear panel for releasably attaching said container to the mating element of the fastener installed at a convenient location.

6. A container according to claim 5 further comprising a small concave detent formed in each side edge of the top portion of said cover top portion, and a small protuberance extending laterally inward from the top portion of each said side panel, said protuberances biasly received within said detents when said cover is in the closed position and released from said detents upon pivotal upward movement of said cover top portion.

* * * * *